US005836025A

United States Patent [19]

Poncy, Sr.

[11] Patent Number: 5,836,025

[45] Date of Patent: Nov. 17, 1998

[54] GEL CONTAINING POSITIONING CUSHION FOR INFIRM PATIENTS

[76] Inventor: George W. Poncy, Sr., 5380 North Ocean Blvd., Apt. 12-J, Singer Island, Fla. 33404

[21] Appl. No.: 798,044

[22] Filed: Feb. 10, 1997

[51] Int. Cl.[6] ..... A47C 27/18; A47C 7/02

[52] U.S. Cl. ..... 5/654; 5/909; 297/452.22; 297/452.25; 156/291; 156/292

[58] Field of Search ..... 5/654, 653, 909; 297/452.25, 452.22, 452.24, 452.41; 156/291, 292

[56] References Cited

U.S. PATENT DOCUMENTS

| | | | |
|---|---|---|---|
| 3,063,749 | 11/1962 | Struble et al. | 297/DIG. 6 |
| 4,643,481 | 2/1987 | Saloff et al. | 5/654 |
| 4,672,700 | 6/1987 | Poncy | 5/654 |
| 4,753,480 | 6/1988 | Morell | 5/654 |
| 4,930,171 | 6/1990 | Frantz | 5/654 |
| 5,189,747 | 3/1993 | Mundy et al. | 5/654 |
| 5,390,384 | 2/1995 | Dinsmoor, III et al. | 5/654 |
| 5,522,106 | 6/1996 | Harrison et al. | 5/653 |
| 5,613,257 | 3/1997 | Graebe | 5/654 |
| 5,687,436 | 11/1997 | Denton | 5/654 |

*Primary Examiner*—Alexander Grosz
*Attorney, Agent, or Firm*—Lane, Aitken & McCann

[57] ABSTRACT

A positioning cushion prevents a sitting infirm patient from sliding forward. The cushion comprises a base portion, and gel bladder filled with a gelatinous mixture of resin and water, and a top cover. The base portion defines thigh supporting recesses and a trough receiving the gel bladder. The base portion and top cover are constructed of a rigid urethane foam and an ergonomic urethane foam respectively. The aforementioned three parts may be then covered with a fabric cover.

10 Claims, 4 Drawing Sheets

GEL CONTAINING POSITIONING CUSHION FOR INFIRM PATIENTS

FIELD OF THE INVENTION

The present invention relates to a positioning cushion that is used to keep an infirm patient in a proper sitting position and prevent the patient from slumping or sliding forward.

BACKGROUND OF THE INVENTION

When some infirm patients are supported in a sitting position in a wheelchair, there is a tendency for the patient to slide or slump forward. When this happens, the patient may not be able to in lift himself back up to a more upright position when his health or condition does not permit him to do so. Such a situation can cause discomfort for the patient.

In addition to the decrease in comfort, the slouching or slumping caused by sliding forward can also cause medical problems. For example, slouching can put pressure on the patient's ischial tuberosities (the bony prominences of the femur or thigh bone). For patients who have little tissue mass in their upper thighs and buttocks, the pressure on the ischial tuberosities can lead to decubitus ulcers.

OBJECTS OF THE INVENTION

It is an object of the present invention to prevent an infirm patient in a wheelchair from sliding down into a slumped position.

It is another object of the invention to reduce the likelihood of decubitus ulcers in a patient in a wheelchair.

SUMMARY OF THE INVENTION

The present invention consists of a three part cushion which helps to prevent a patient from sliding down or slumping when supported in a sitting position. The cushion also reduces the pressure on a patient's upper thighs, buttocks and coccyx. The cushion comprises a square or rectangular base portion referred to as a saddle base which is constructed of relatively rigid urethane foam and which must be rigid and dense enough to support the weight of a patient without any substantial compression. One portion of the base contains two parallel recesses which receive and support the undersides of the upper thighs of a patient. The other portion of the saddle base contains a trough which receives a gel bladder and supports the buttocks of the patient.

The second component of the cushion is the gel bladder. The gel bladder is comprised of two pieces of vinyl film, or other suitable thermoplastic material, fused or sealed together to make a bladder. The bladder is injected with a suitable resin and water and then agitated to form a gelatinous mixture. After the gelatinous mixture forms, the bladder is positioned in the trough of the saddle base.

The third component of the cushion consists of a top cover constructed of an ergonomic urethane foam which covers the entire saddle base and the gel bladder. The saddle base, gel bladder and top cover are held together by an adhesive. The ergonomic urethane foam compresses very slowly, and also returns to its natural shape very slowly. The top cover is glued to the saddle base through holes formed in marginal areas of the gel bladder to anchor the top cover to the saddle base. The gel bladder and top cover are encased in a conventional fabric outer cover.

The present invention serves to prevent patients who are sitting up from sliding forward into a slumped position. The cushion is placed under the posterior of the patient so that the underside of the patient's upper thighs are supported over the two parallel recesses of the saddle base and the patient's buttocks are supported over the gel bladder. The ergonomic urethane foam conforms to the shape of the patient's upper thighs and buttocks. Because of the trough containing the gel bladder, the buttocks are supported in a slightly lower position than the upper thighs so that the patient is prevented from sliding forward.

The gel bladder is shaped to define a recess under the sitting patient's coccyx to eliminate discomfort and trauma from pressure on the coccyx.

DETAILED DESCRIPTION OF THE PREFERRED EMBODIMENTS

The present invention relates to a positioning cushion which is used to prevent a person who is sitting in a wheelchair from slumping in or sliding down the wheelchair.

Figure 1:
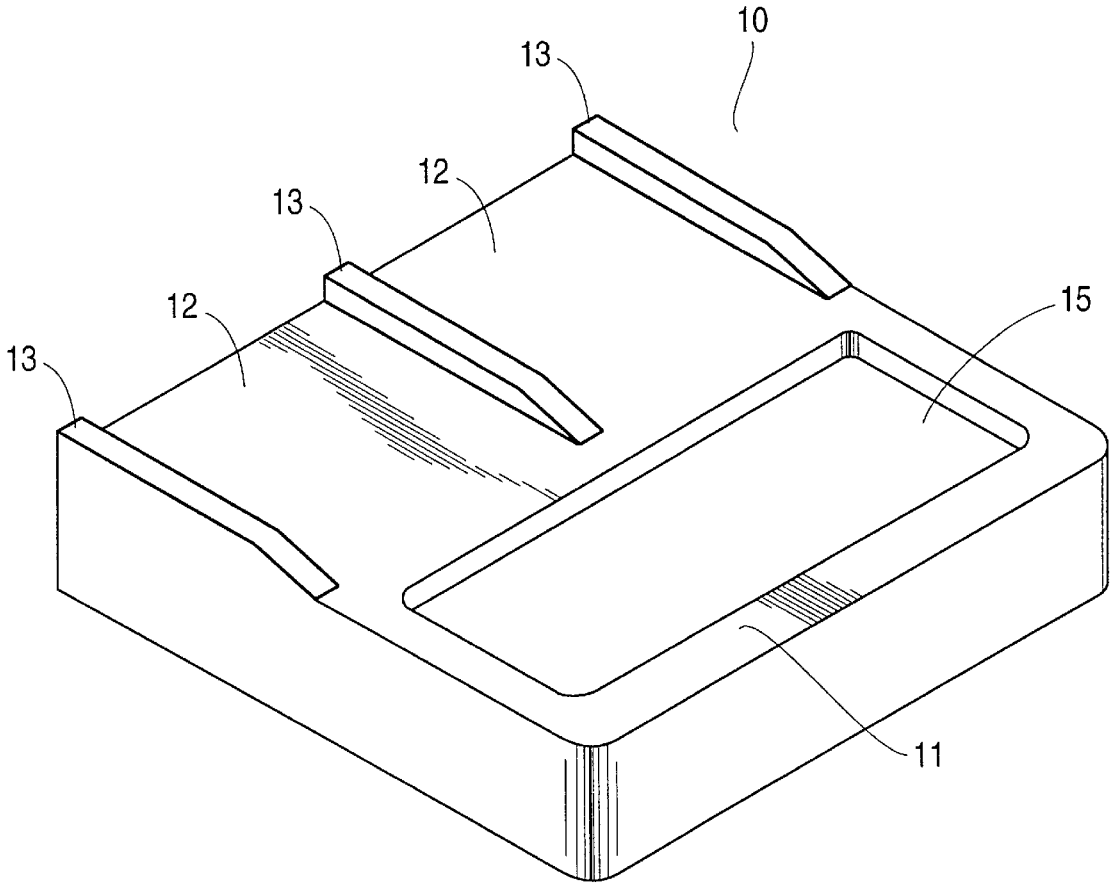
FIG. 1 is a perspective view of the saddle base portion of the invention.

FIG. 1 illustrates a saddle base 10 of the cushion which is constructed of a relatively rigid high density urethane foam. A portion of the saddle base 10 contains two parallel recesses 12 which are formed by parallel dividers 13. The remaining portion 14 of the saddle base 10 adjacent to the parallel recesses 12 contains a trough 15 surrounded by a shelf 11.

Figure 2:
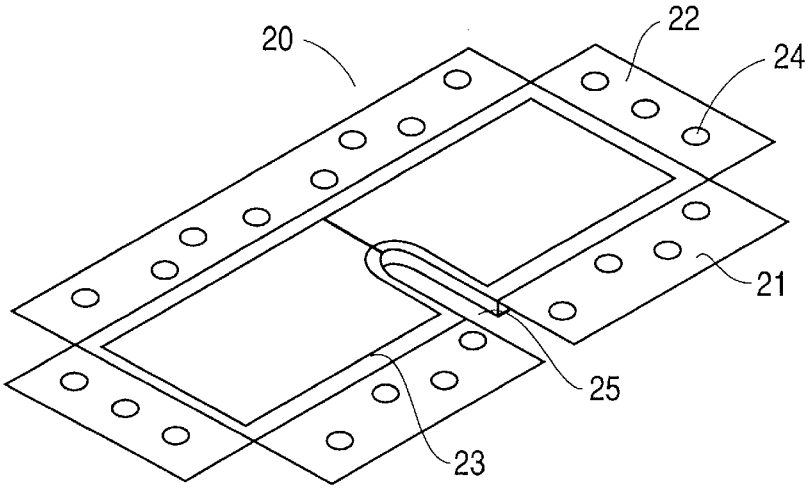
FIG. 2 is a perspective view of the gel bladder portion of the invention.
Figure 6:
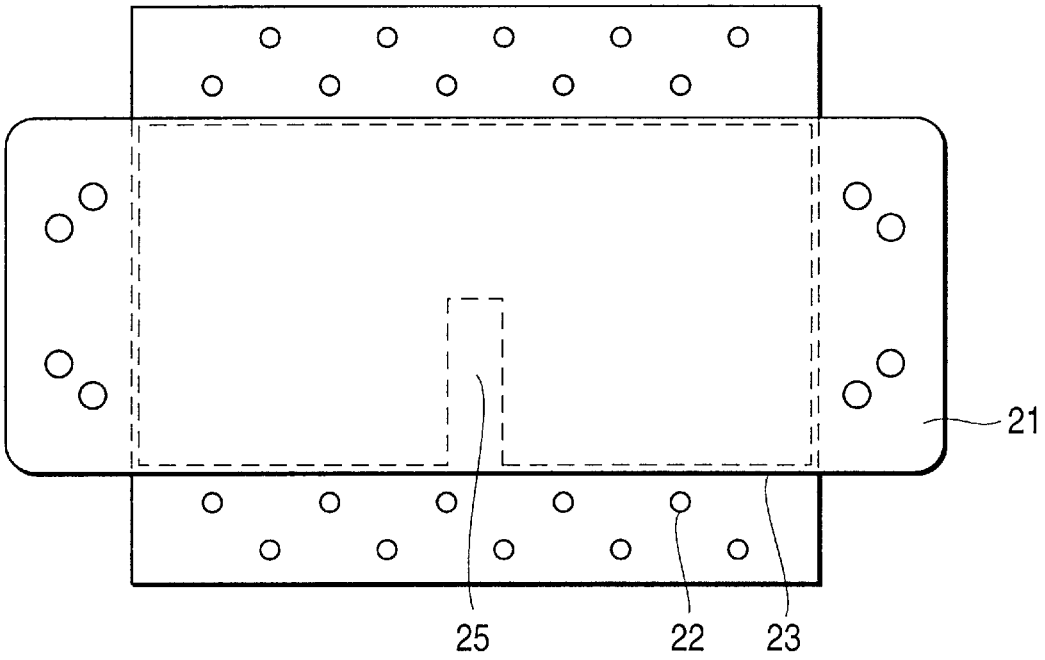
FIG. 6 is an elevational view of the gel bladder.
Figure 7:
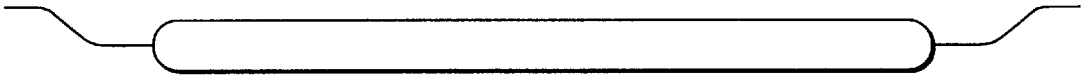
FIG. 7 is a side view of the gel bladder.

FIG. 2 illustrates a gel bladder 20 which is constructed of two rectangular pieces of vinyl film panels 21 and 22. The two panels 21 and 22 can also be constructed of some other suitable thermoplastic material. Panel 21 is placed over panel 22 as illustrated in FIG. 6 so that the marginal areas of both panels 21 and 22 extend beyond one another. The two panels 21 and 22 are fused to each other along line 23 as shown in FIG. 2 via an electronic RF press to form a bladder 20 within the seal line 23. The seal line 23 is shaped in a manner so that the marginal areas lie beyond the seal line 23. The seal line 23 forms a U-shaped recess 25 as shown in FIGS. 2 and 6 to accommodate a patient's coccyx and reduce pressure applied to the patient's coccyx. A plurality of holes 24 are then punched into the marginal areas beyond the seals. FIG. 7 is a side view of the bladder 20 after the panels 21 and 22 have been fused together.

After the two panels 21 and 22 are fused together, a mixture of resin and water is injected into the bladder 20, and the resin and water are agitated to form a gelatinous composite. A liquid adhesive is placed around the shelf 11 surrounding the trough 15 in the saddle base 10, and the bladder 20 is placed in the trough 15. The marginal areas beyond the fused line 23 of the panels 21 and 22 adhere to the saddle base 10 via the adhesive.

Figure 3:
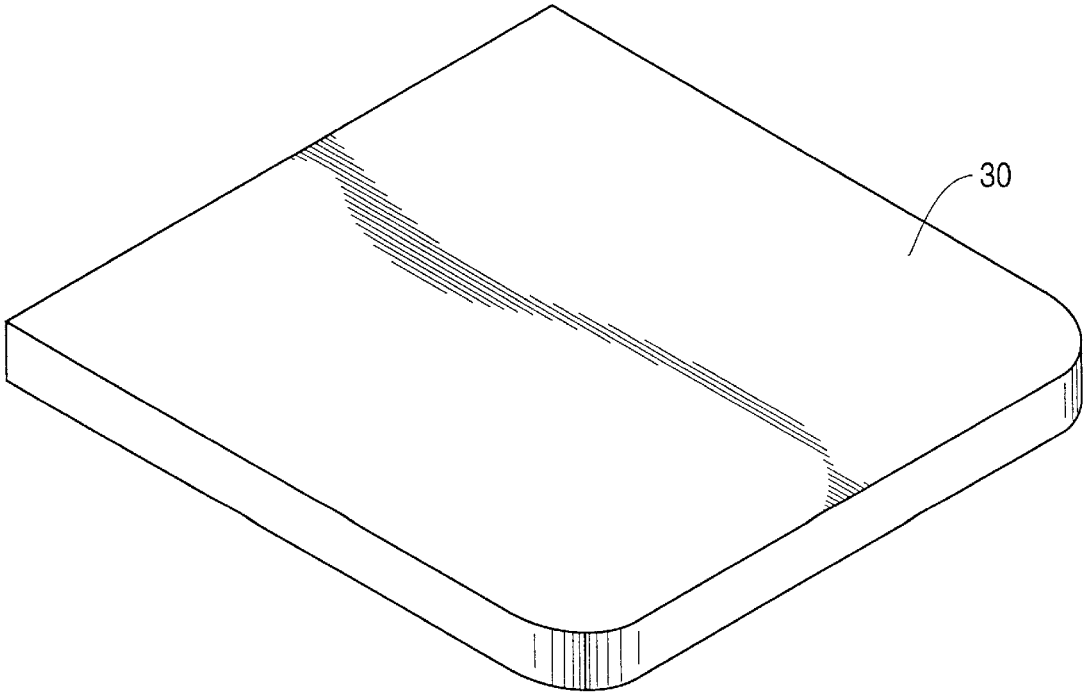
FIG. 3 is a perspective view of the top cover portion of the invention.

FIG. 3 illustrates a top cover 30 made of ergonomic urethane foam which is placed over the saddle base 10 and the gel bladder 20. The ergonomic urethane foam is resilient and has the characteristic of compressing very slowly and recovering very slowly. Before the cover 30 is positioned on the saddle base 10 and the gel bladder 20, the underside of the cover is coated with the same adhesive as was placed on the shelf 11 of trough 15. The adhesive serves to bond together the saddle base 10, gel bladder 20 and cover 30. The marginal areas of the gel bladder 20 do not extend to the coextensive edges of the saddle base 10 and cover 30, but rather stop about ⅓" from these edges. This allows the adhesive to form an unencumbered foam to foam seal around the perimeter of the cushion. Additionally, the adhesive that was placed on the shelf 11 bleeds through the holes 24 and also acts to form a union between the saddle base 10, and the cover 30 and anchoring the bladder 20 in place.

Figure 4:
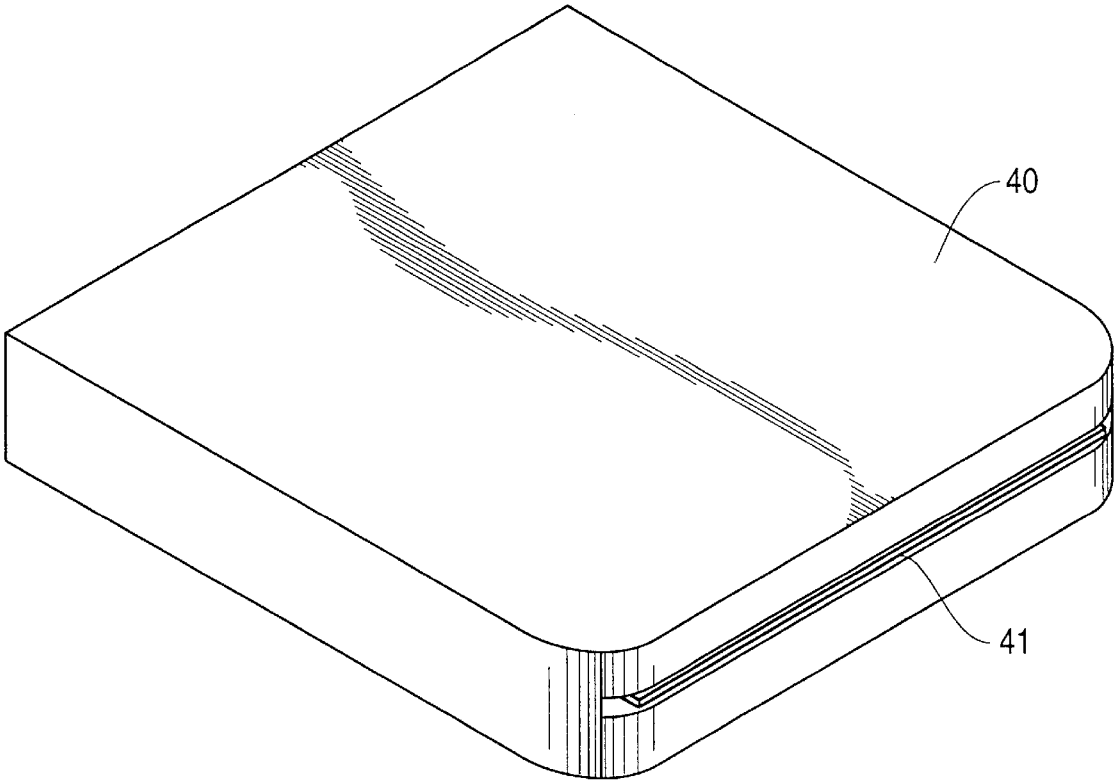
FIG. 4,is a perspective view of a conventional cover used to encase the cushion.

FIG. 4 illustrates an outer fabric cover 40 with a zipper 41 therein. After the saddle base 10, gel bladder 20 and top portion 30 are assembled, the cushion is encased in the outer cover 40 and the cover 40 is closed by zipper 41. The outer cover 40 serves mainly to protect the inside portions of the cushion.

Figure 5:
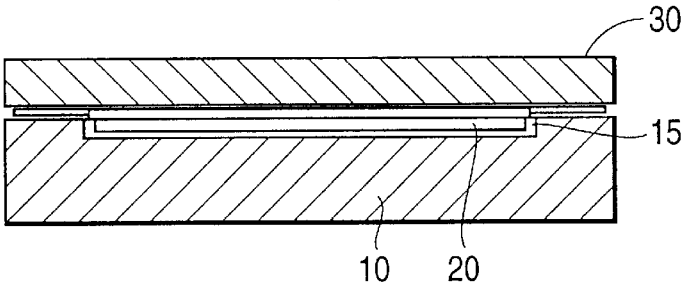
Fig. 5 is a cross sectional view of the present invention showing the gel bladder positioned in a trough within the saddle base and the top cover positioned on the saddle base and gel bladder.

FIG. 5 is a cross sectional view of the assembled cushion showing the gel bladder 20 positioned in the trough 15 of saddle base 10 and top cover 30 positioned thereon.

The assembled cushion supports a sitting patient with the patient's buttocks resting on the portion of the cushion over the gel bladder 20. The patient's thighs rest on the portion of cushion over parallel recesses 12. The ergonomic urethane foam of the top cover 30 allows the patient's buttocks to sink into the top 2cover 30 and in combination with the gel bladder distributes the support of the patient uniformly over the patient's buttocks and upper thighs. The ability of the ergonomic urethane foam of the top cover 30 to form around the buttocks of the patient, in conjunction with the ability of the urethane foam to form around the slope of the saddle base 10, in effect provides a shaped support corresponding to the shape of the buttocks and underside of the patient's thighs. The gel bladder allows the buttocks to sink to a position slightly lower than the upper thighs and adds to the shaping of the support to the buttocks. This arrangement and the uniform support achieved by the cushion serves to prevent the patient from slumping or sliding forward.

While the invention has been described in terms of the aforementioned embodiments, those skilled in the art will recognize that the invention can be practiced with modification within the spirit and scope of the appended claims.

I claim:

1. A positioning cushion to support a sitting patient, comprising:

a rigid saddle base comprising a front portion defining thigh supporting front surfaces, and a rear portion defining a trough adjacent to said front surfaces;

a gel bladder, said gel bladder positioned in said trough; and a resilient foam top cover mounted over said saddle base and said gel bladder, said gel bladder further comprising a recessed portion, said recessed portion positioned in said gel bladder to receive a sitting person's coccyx said trough having sufficient size so that said gel bladder in said trough will allow the buttocks of a sitting person to sink to a position lower than the upper thighs of such person supported on said thigh supporting front surfaces.

2. A positioning cushion according to claim 1, wherein said front surfaces are separated by a divider formed in the shape of a ridge.

3. A positioning cushion according to claim 1, wherein said saddle base is constructed of a rigid urethane foam.

4. A positioning cushion according to claim 1, wherein said top cover is constructed of ergonomic urethane foam.

5. A positioning cushion according to claim 1, further comprising an outer fabric cover encasing said cushion.

6. A positioning cushion according to claim 1, wherein said saddle base, gel bladder and top cover are held together by an adhesive.

7. A method to prevent a sitting person from slipping forward, using the positioning cushion of claim 1, comprising the step of:

supporting said person in a sitting position with said gel bladder directly under the buttocks of said person and said front surfaces under the thighs of said person, and with the buttocks of said person supported at a position lower than the upper thighs of said person.

8. A positioning cushion according to claim 1 wherein the gel containing portion of said bladder is formed in the shape of a U, said recessed portion being positioned between the arms of said U.

9. A positioning cushion to support a sitting patient, comprising:

a rigid saddle base comprising a front portion defining thigh supporting front surfaces, and a rear portion defining a trough adjacent to said front surfaces;

a gel bladder, said gel bladder positioned in said trough;

a resilient foam cover mounted over said saddle base and said gel bladder; and said saddle base, gel bladder, and top cover being held together by an adhesive, said gel bladder further comprising a plurality of holes in its marginal edges, said holes allowing for the communication of said adhesive between said saddle base, said gel bladder and said top cover.

10. A positioning cushion to support a sitting patient, comprising:

a rigid saddle base comprising a front portion defining thigh supporting surfaces, and a rear portion defining a trough adjacent to said front surfaces;

a gel bladder, said gel bladder having a gel containing portion positioned in said trough; and a resilient foam top cover mounted over said saddle base and said gel bladder, said gel bladder having a marginal portion extending around the edges of said gel containing portion, said marginal portion being sandwiched between and fixed to said saddle base and said top cover, around the edges of said trough.

* * * * *